US006624797B1

(12) United States Patent
Wheeler et al.

(10) Patent No.: US 6,624,797 B1
(45) Date of Patent: Sep. 23, 2003

(54) METHOD AND APPARATUS FOR PROVIDING VIDEO AND CONTROL TO A MONITOR

(75) Inventors: Peter Wheeler, Mississauga (CA); Vijay Sharma, Oakville (CA); Richard W. Ledrew, Thornhill (CA)

(73) Assignee: ATI International Srl, Christchurch (BB)

( * ) Notice: Subject to any disclaimer, the term of this patent is extended or adjusted under 35 U.S.C. 154(b) by 0 days.

(21) Appl. No.: 09/280,359

(22) Filed: Mar. 29, 1999

(51) Int. Cl.[7] ..... G09G 5/00
(52) U.S. Cl. ..... 345/1.2; 710/63
(58) Field of Search ..... 345/3, 512, 102, 345/409, 158, 1.3, 1.2; 710/129, 3, 62, 63, 64, 65, 69, 70; 370/494; 439/638, 540.1, 362

(56) References Cited

U.S. PATENT DOCUMENTS 5,856,819 A * 1/1999 Vossler ..... 345/102
5,958,020 A * 9/1999 Evoy et al. ..... 710/3
5,977,995 A * 11/1999 Yassaie ..... 345/512
5,995,150 A * 11/1999 Hsieh et al. ..... 345/409
6,044,428 A * 3/2000 Rayabhari ..... 710/129
6,064,566 A * 5/2000 Agata et al. ..... 361/684
6,069,899 A * 5/2000 Foley ..... 370/494
6,232,932 B1 * 5/2001 Thorner ..... 345/1.3
6,314,479 B1 * 11/2001 Frederick et al. ..... 710/63

OTHER PUBLICATIONS

DDGW, Digital Display Working Group, "Digital Visual Interface DVI", Revsion 1.0, Apr. 2, 1999, p. 18.*
"VESA Plug and Display Standard," Version 1, Revision 0, Revision Date: Jun. 11, 1997; Video Electronics Standards Association.
O'Donnel, Bob; "Flat–panel fiasco: Lack of standards could slow acceptance of high–tech monitors"; Dec. 21, 1998; pp. 1–3; from www.everythingcomputers.com.
Video Electronics Standards Association; "VESA Plug and Display (P&Dtm) Standard Version 1"; Jun. 11, 1997; pp. 1–111.

* cited by examiner

*Primary Examiner*—Dennis-Doon Chow
(74) *Attorney, Agent, or Firm*—Vedder, Price, Kaufman & Kammholz

(57) ABSTRACT

A method and apparatus for combining a control signal and a video signal on a standard video cable is disclosed. The video cable is connected to a display monitor in order to provide access and control functions to the monitor. In a particular implementation, a USB signal is transmitted with a digital video signal across a standard digital video connector.

30 Claims, 3 Drawing Sheets

--PRIOR ART--

METHOD AND APPARATUS FOR PROVIDING VIDEO AND CONTROL TO A MONITOR

FIELD OF THE INVENTION

The present invention relates to providing video and bidirectional control through a common interface to a display device of a computer system.

BACKGROUND OF THE INVENTION

FIG. 1 illustrates a portion of a computer system connected to a monitor. For the convenience of the user, a USB port has been provided at the monitor. In order to provide the USB functionality at the monitor, a USB port of the system has been connected to a second USB port (not shown) on the monitor. Generally, the USB port provided at the monitor is merely passed through for the user's convenience. This eliminates the user having to connect to the chassis of a computer system, which can be hard to access, whenever a peripheral is desired to be added. The computer system also illustrates a video graphics adapter providing a signal to the video cable driving the monitor of the prior art system.

The prior art implementation of FIG. 1 is often inconvenient because multiple cables are needed to be connected to the monitor. This adds cost to the system and is inconvenient. One prior art solution was proposed using a plug-and display (P&D) cable. This cable was designed to be a universal video interface which provided both digital and analog interfaces for video data together with serial bus options. However, the plug-and display standard has been largely rejected due to the bulky size of the cable, the cost of providing both digital and analog signals when in many instances only one of the signals is required, and due to the size of the connector to support such a cable.

Therefore, an interface solution that eliminated the number of connections required at the monitor, and maintained convenience and existing standards would be desirable.

DETAILED DESCRIPTION OF THE DRAWINGS

In accordance with the present invention, a control signal is transmitted using a video cable to a display monitor in order to provide access and control functions to the monitor. In a particular implementation, a USB signal is transmitted with a digital video signal across a standard digital video connector.

Figure 1:
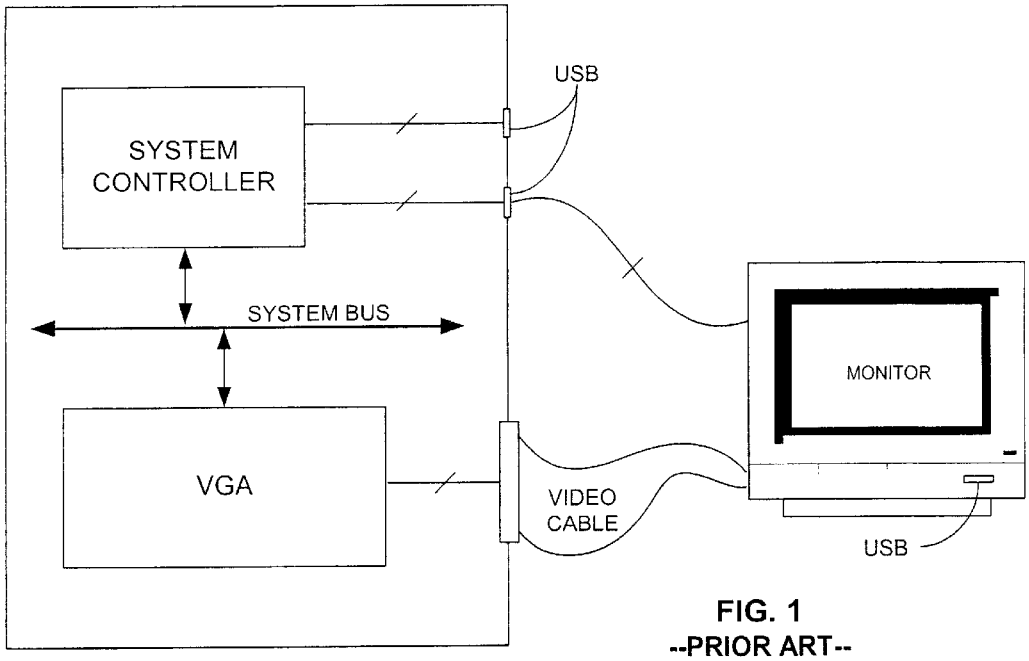
FIG. 1 illustrates in block diagram form a prior art video system connected to a monitor.
Figure 2:
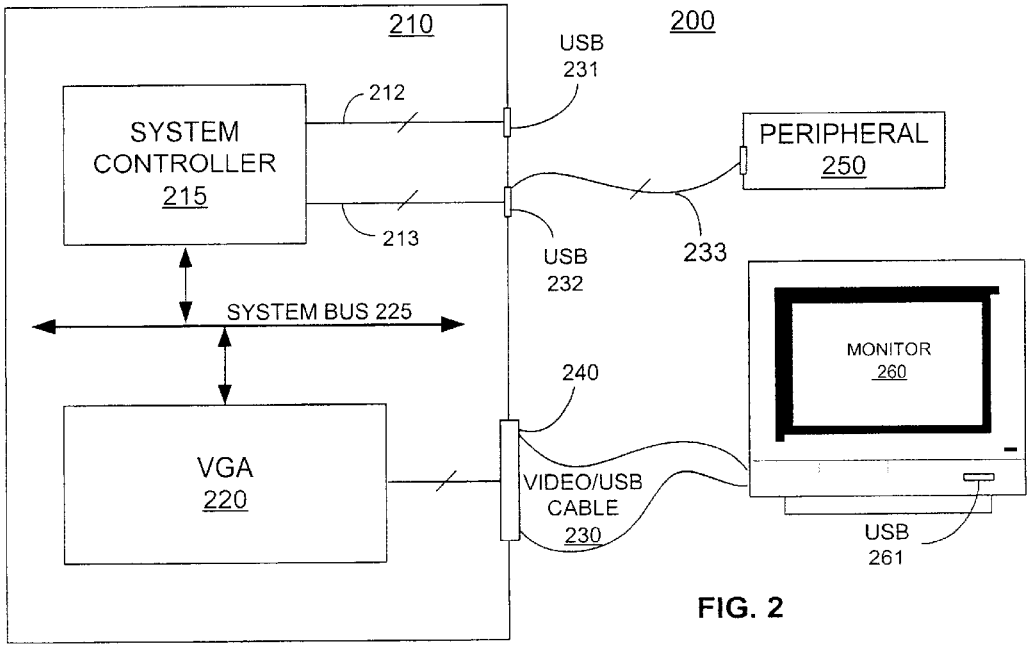
FIG. 2 illustrates in block diagram form a data processing system connected to a monitor in accordance with the present invention.

In accordance with the present invention, FIG. 2 illustrates a data processing system 210, a peripheral 250, and a monitor 260. In a specific embodiment, the data processing system 210 has a chassis (not illustrated) through which the USB ports 231 and 232 are accessible. In addition, a video cable port, or connector, 240 is accessible through the data processing system. However, the video connector 240 may be accessible either through the chassis of the data processing system 210, or via an add-on board which supports video for the data processing system 210. Where an add-in card is present, the connector 240 is part of the card and not actually connected through the chassis.

In operation, the peripheral 250 would be capable of receiving and transmitting USB signals as needed for proper operation. In a specific implementation, the peripheral 250 has been connected to the USB port 232 via a USB cable 233. Likewise, the monitor 260 has been connected to the data processing system through the video/USB cable 230. The video/USB cable 230 provides both the required video signals necessary to display video graphics on the monitor 260, and the USB signals necessary to transmit and receive signal between the monitor 260 and the system 210.

USB connector 261 is illustrated to be accessible via the front of the monitor 260. One of ordinary skill in the art would recognize that the actual USB connector could be added to any location on the monitor deemed convenient by a manufacturer.

In a specific embodiment of the present invention, the video/USB cable 230 would be a standard digital flat panel (DFP) display cable as specified by the Video Electronics Standards Association (VESA). In another specific embodiment of the present invention, the video/USB cable 230 would be a standard DFP display cable specified by the Digital Display Working Group (DDWG) Digital Visual Interface (DVI) specification. By utilizing a standard cable, it is possible to gain cost efficiencies in manufacturing, and implementation, because of availability of the cable.

The data processing system 210 further includes a system controller 215, a VGA controller 220, a system bus 225 for connecting the system controller 215 and the VGA 220 to one another, a first USB port 231, a second USB port 232, and a video connector 240. In operation, the system controller 215 will provide control to the USB ports 231 and 232 via the internal connectors 212 and 213. One of ordinary skill in the art will recognize various numbers of USB ports can be provided.

In the embodiment illustrated, the VGA 220 is used to integrate the USB bus and the video bus onto a common cable 230 through the connector 240. In one implementation, the VGA 220 is connected to the USB of system controller 215 by receiving USB signals from the system controller 215. For example, bus 212 or 213 can be provided to the VGA 220, as will be described later. The received signal can then be integrated onto the common connector 240 via the VGA 220. In another embodiment, the system controller 215 provides the VGA 220 the appropriate USB information across the system bus 225 to allow for the VGA 220 to implement the USB protocol and provide USB signals to the unified connector 240. For example, the system bus 225 can be an AGP (Accelerated Graphics Port) Bus or PCI (Peripheral Components Interconnect) associated with the system 200, and the VGA 220 can utilize bus mastering to send and receive AGP or PCI data.

Figure 3:
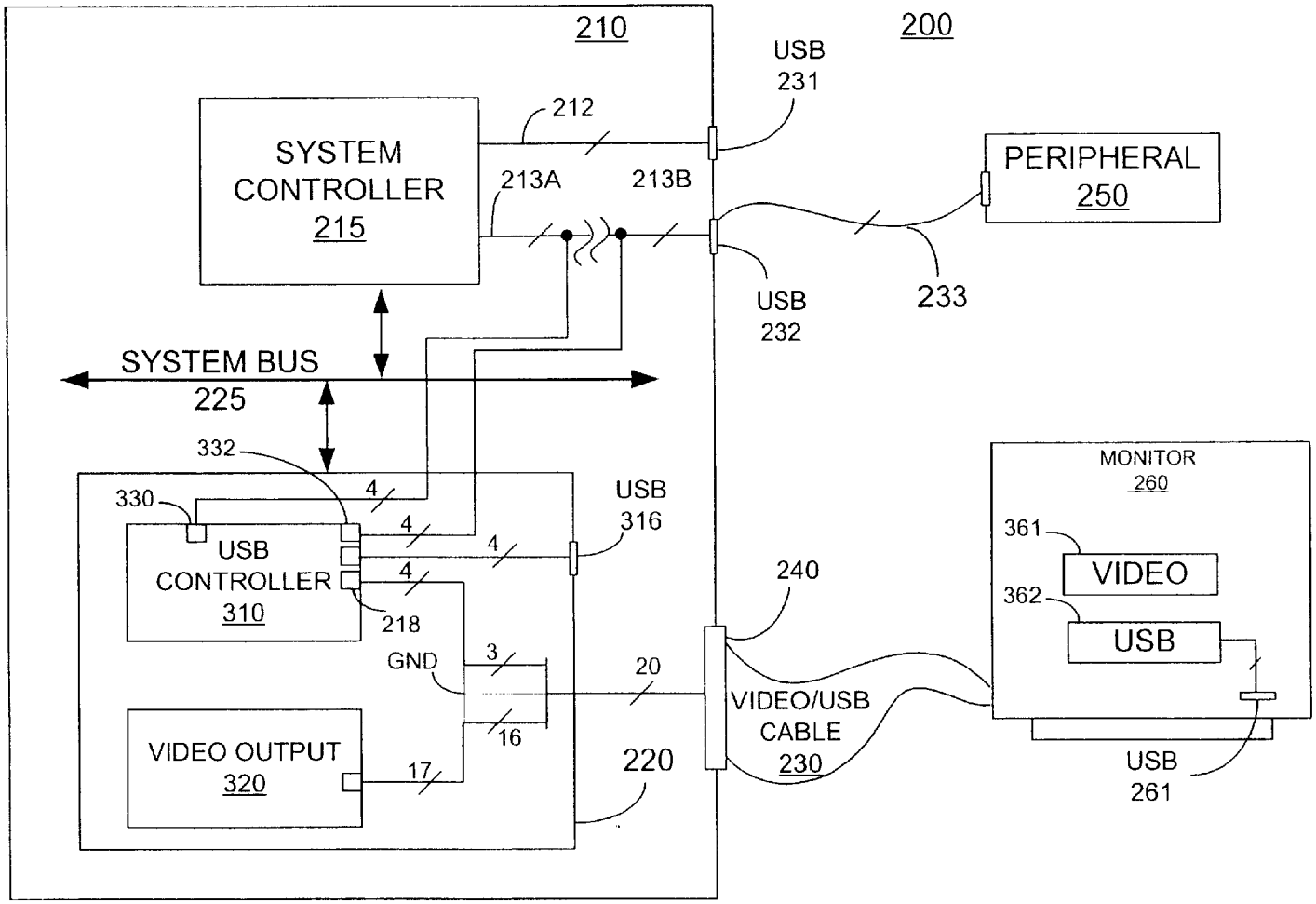
FIG. 3 illustrates in block diagram form a video graphics adapter of FIG. 2 in more detail.

FIG. 3 illustrates a specific implementation of the graphics adapter 220 in greater detail. The video graphics adapter 220 includes a USB controller 310 and a video-out circuit controller 320. The video-out "Circuit Controller" 320 provides the video output to the connector 240. The USB controller 310 receives the USB signal from the bus portion 213A in order to connect the USB controller 310 of the VGA 220 to the USB controller of the system controller 215 of FIG. 2. In one implementation, a 5-port USB controller 310 is used. A 5 port controller is capable of supporting four USB downstream ports and one upstream port. The upstream port 330 is used to connect the controller 310 to the system controller 215. A downstream USB port 332 is used in order to provide a USB signal to the USB port 232 via USB bus 213A. A second downstream USB port 218 is used to integrate a USB protocol onto the common connector 240. In the specific implementation, the third downstream USB port 316 is illustrated to provide yet another USB connector at the edge of the add-in card, or the chassis, through connector 240.

When the integrated connector 240 is a DFP connector, it is necessary to combine signals between the two protocols. This is necessary because the DFP cable is a 20-pin cable that uses 17 of the 20 pin for its protocol, wherein the USB cable is a 4-pin protocol. Since 21 pins are not available on the connector, it is necessary to combine at least two pins between the protocols. This is illustrated in FIG. 3 where the 17-wire DFP bus and 4-wire USB buses, are shown to split off one pin and combine it at the connector 240. In a specific implementation of the present invention, this signal is chosen to be the ground signal. In other implementations, power pins of the video protocol and USB protocol can be appropriately regulated and combined.

By multiplexing the ground pin between the two controllers 310 and 320, it is possible to transmit both video and USB control signals, over a single cable. When received at monitor 260, the common ground is supplied back into the USB bus and video bus as appropriate. This is indicated in FIG. 3 where a video controller 361 and a USB controller 362 receive the signal.

Also illustrated in FIG. 3, is a USB connector 261. The USB connector 261 can be output directly from the connector 240, or it could be generated by USB controller 362.

In the specific implementation where a DFP cable is used, the video signals are transmitted over pins 1–8, 11–16, and 18–20. The USB signal would be transmitted over the pins 9, 10, and 17. The common signal would be the ground signal located at pin 7 of the DFP cable; the USB+ signal at pin 9, the USB-signal at pin 10; and 5V at pin 17. Each of the USB pins will generally be protected by over current and electrostatic discharge protection by the specific implementation. In addition, voltage regulation will be provided by the system as needed. For example, the 5 volt signal can either be generated by the specific implementation or passed through from another power supply (not shown) or AGP bus or PCI bus as needed.

In operation, it is possible for the video and the USB signals to be transmitted either independently, wherein only one of the signal will be operational at any given time, or simultaneously. In general, the signals will be transmitted independent of one another but simultaneously. Therefore transmission occurring at the same time would not be a mutually exclusive requirement of the system.

It would also be recognized by one of ordinary skill in the art that this procedure can be used with other such cable connectors having, for example, 24 pins or other suitable number of pins. For example, other digital cables or a standard analog cable which utilizes only a portion of the cable could also be used to combine one or more USB control ports. In this situation, the USB signals as illustrated in FIG. 3 can also be provided to the connector 240 in order to provide multiple USB control lines to the monitor 260. In this embodiment, one of the control signals can be used to provide control to the monitor while the other USB control signal is used to support the external USB port 261.

For video connectors which do not have spare pins, the low speed Digital Display Channel (DDC) from the monitor (which consists of 4 wires-power, ground, + and – signaling) carrying monitor configuration to the host system, can be packetized and multiplexed over a USB link. Thus further reduction of cable pairs and connector pins and size is realized.

The present invention is advantageous over the prior art in that it reduces cost by eliminating the number of cables required to connect monitors to the data processing system, and because in one implementation it utilizes an industry standard DFP cable, and in another, an industry standard DVI cable, whereby no modifications are needed to be made to the cable or monitors to which the cables connect. Specifically, existing monitors which do not support the USB signals will receive the signals transmitted over the USB portions of the cable but not processed or utilized there. Thereby, there would be no necessary retrofitting of existing equipment, and it would continue to work, even though the VGA has been upgraded to utilize such features.

Figure 4:
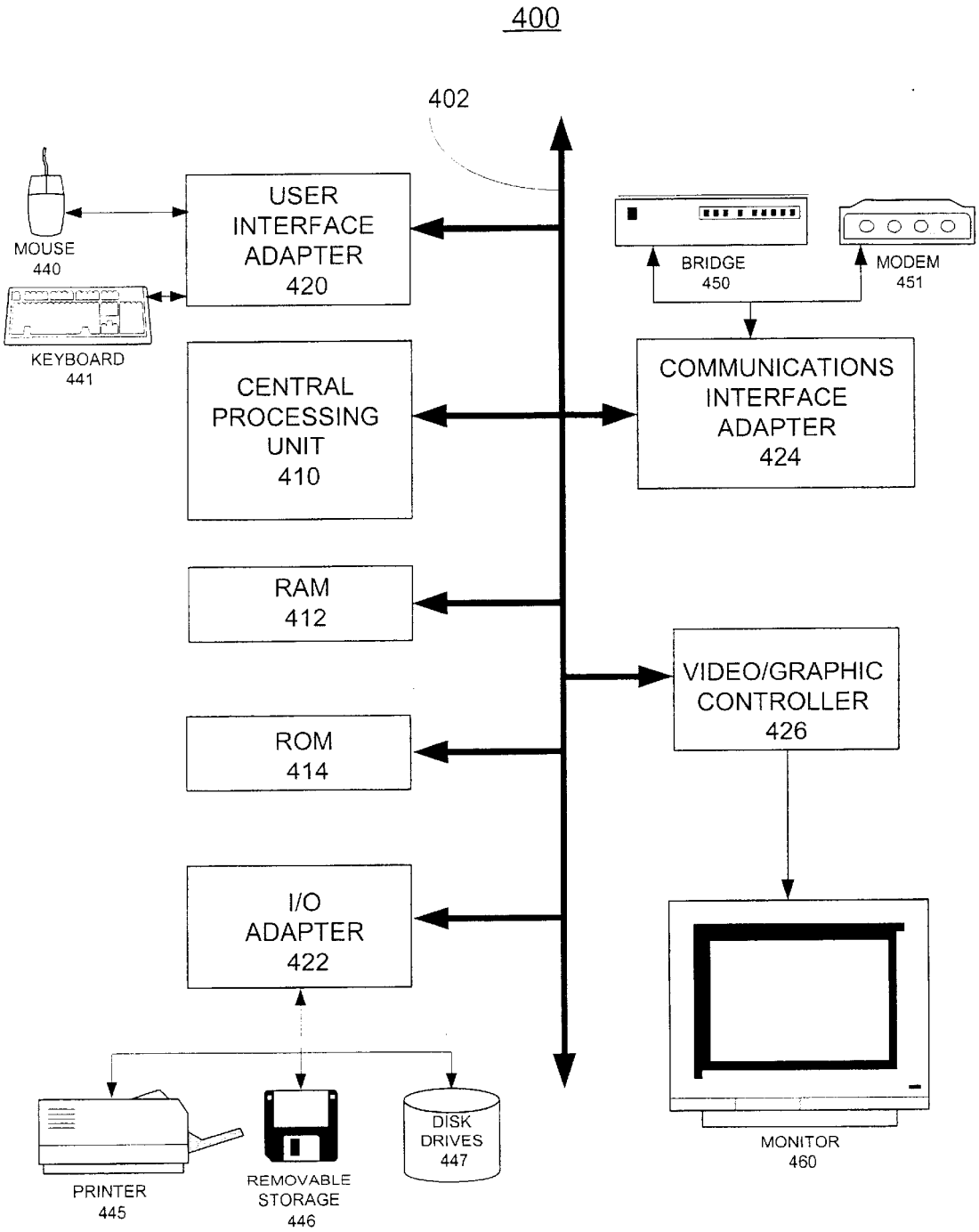
FIG. 4 illustrates a data processing system in block form in accordance with implementing the present invention.

FIG. 4 illustrates a data processing system 400, such as may be used to implement the present invention. The system of FIG. 4 includes a central processing unit (CPU) 410, which may be a conventional or proprietary CPU, random access memory (RAM) 412, read-only memory (ROM) 414, and input/output adapter 422 for connecting peripheral devices, a user interface adapter 420 for connecting user interface devices, a communications adapter 424 for connecting the system 400 to other networks, and a video graphic controller for displaying video and graphic information. Each of these components is connected to one another through a system bus 402.

The I/O adapter 422 is further connected to disk drives 447, printers 445, removable media storage devices 446, tape units (not shown) and bus 402. Other storage devices may also be interfaced to the bus 402 through the I/O adapter 422. Digital audio USB speakers on the monitor can be connected.

The user interface adapter 420 is connected to a keyboard device 441 and a mouse 440. Other user interface devices such as a touch screen device (not shown) may also be coupled to the system bus 402 through the user interface adapter 420. The user interface adapter may be a USB port. A communications adapter 424 is connected to bridge 450 and/or a modem 451. Furthermore, a video graphics controller 426 connects the system bus 402 to a display device 460. In operation, the bus 402 of FIG. 4 can correspond to the system bus 225 of FIG. 2. The video graphics controller 426 can correspond to the video graphics adapter 220 of FIG. 2. In addition, methods associated with the present invention, if any, may be implemented in whole or in part, by the system 400. Such code implementing these methods can be stored on computer-readable media such as the one or more of the storage devices 445, 446, and 447.

Since the apparatus implementing the present invention is, for the most part, composed of electronic components and circuits known to those skilled in the art, circuit details are not be explained in any greater detail than considered necessary as illustrated above.

The present invention has been illustrated herein through the use of specific embodiments of the invention. One of ordinary skill in the art would appreciate that many variations to the present invention could be implemented. For example, while the video connection is described as a DFP or DVI connection, other connections consistent with the disclosure may be used.

We claim:

1. A method of transmitting digital video and control signals to a video display, a method comprising the steps of:

receiving a Universal Serial Bus (USB) signal at a video connector, that is at least one of: a Digital Flat Panel (DFP) connector, and a Digital Visual Interface (DVI) D connector;

receiving a digital video signal at said connector;

transporting the USB signal and said digital video signal through said connector for transmission.

2. The method of claim 1, wherein the USB signal and the digital video signal share a single pin in said connector that carries at least one of:

a ground signal for both said USB signal and said video signal;

a five-volt signal for both said USB signal and said video signal;

video signals multiplexed with USB signals.

3. The method of claim 1, further comprising the steps of receiving a digital video signal coupling the USB signal and the digital video signal to form a coupled signal; and the step of transporting includes transmitting the USB signal as part of the coupled signal.

4. The method of claim 3, wherein the coupled signal is physically coupled.

5. The method of claim 4, wherein the physically coupled signal is physically coupled based on a pin assignment of the digital video connector.

6. The method of claim 5, wherein the digital video connector has a first set of nodes assigned to the USB signals, and a second set of nodes assigned to the video signal.

7. The method of claim 6, wherein the first and second set of nodes share at least one node.

8. The method of claim 7, wherein the at least one node is a common voltage reference node.

9. The method of claim 4 wherein the coupled signal transports the USB signal and the digital signal simultaneously.

10. The method of claim 4 wherein the coupled signal transports the USB signal and the digital signal independently.

11. A video system comprising:

a video-out bus having X nodes coupled to a digital video connector;

a USB bus having 4 nodes coupled to the digital video connector;

the digital video connector having one of 20 pins and 24 pins.

12. The video system of claim 11, wherein X is equal to 17.

13. The video system of claim 12, wherein one node of the video-out bus, and one node of the USB bus are coupled to a common pin of the digital video connector.

14. The video system of claim 13, wherein each of the one node of the video-out bus and the one node of the USB bus are coupled to a common voltage reference port.

15. The video system of claim 14, wherein the common voltage reference port is to be connected to a common ground.

16. The video system of claim 11, wherein the digital video connector is one of a Digital Flat Panel (DFP) connector and a Digital Flat Panel DVI-D connector.

17. A data processing system comprising:

chassis connectors including a first and second USB connector;

a controller having a first and a second USB port;

a video controller having a first USB port coupled to the first USB port of the controller, a second USB port coupled to the first USB connector, a third USB port, and a video port.

18. The system of claim 17, further comprising:

a video-out connector coupled to the video port and the third USB port.

19. The system of claim 18, wherein the video port and the video-out connector are a digital port and connector respectively.

20. The system of claim 19, wherein the video-out connector is one of a Digital Flat Panel connector and a Digital Visual Interface DVI-D connector.

21. A monitor comprising:

a video-in bus having X nodes coupled to a digital video connector;

a control bus coupled to the digital video connector;

the digital video connector having one of 20 pins and 24 pins.

22. The monitor of claim 21, wherein the control bus is a USB bus having four nodes.

23. The monitor of claim 21, wherein X is equal to 17.

24. The monitor of claim 22, wherein one pin of the video-in connector is coupled to one node of the USB bus and to one node of the video-in bus.

25. The video system of claim 23, wherein the one pin of the video-in connector is to receive a common voltage signal.

26. A method of transmitting digital video and control signals to a video display, a method comprising the steps of:

receiving a control signal over X nodes;

transporting the control signal and a digital video signal to a digital video connector that is at least one of: a Digital Flat Panel (DFP) connector and a Digital Visual Interface (DVI) connector for transmission to said video display.

27. The method of claim 26, wherein the control signal and the digital video signal share a single pin in said digital video connector that carries at least one of:

a ground signal for both said USB signal and said video signal;

a five-volt signal for both said USB signal and said video signal;

digital video signals multiplexed with USB signals.

28. The method of claim 26, further comprising the steps of receiving a digital video signal;

coupling the control signal and the digital video signal to form a coupled signal; and the step of transporting includes transmitting the control signal as part of the coupled signal.

29. The method of claim 28, wherein the coupled signal is physically coupled.

30. The method of claim 26, further comprising the step of limiting over-voltage signals on at least one of the X nodes.

* * * * *